US011846003B2

(12) United States Patent
Hirashima et al.

(10) Patent No.: US 11,846,003 B2
(45) Date of Patent: Dec. 19, 2023

(54) HIGH-STRENGTH STEEL SHEET AND METHOD FOR MANUFACTURING THE SAME

(71) Applicant: JFE STEEL CORPORATION, Tokyo (JP)

(72) Inventors: Takuya Hirashima, Tokyo (JP); Shimpei Yoshioka, Tokyo (JP); Shinjiro Kaneko, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 307 days.

(21) Appl. No.: 17/290,155

(22) PCT Filed: Sep. 25, 2019

(86) PCT No.: PCT/JP2019/037689
§ 371 (c)(1),
(2) Date: Apr. 29, 2021

(87) PCT Pub. No.: WO2020/090303
PCT Pub. Date: May 7, 2020

(65) Prior Publication Data

US 2022/0002827 A1 Jan. 6, 2022

(30) Foreign Application Priority Data

Oct. 31, 2018 (JP) ..... 2018-204876

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C21D 1/06; C21D 2211/002; C21D 2211/008; C21D 6/002; C21D 6/008;
(Continued)

(56) References Cited

U.S. PATENT DOCUMENTS

2011/0287280 A1 11/2011 Shiraki et al.
2016/0369369 A1 12/2016 Takashima et al.
(Continued)

FOREIGN PATENT DOCUMENTS

CN 108474069 A 8/2018
EP 3 399 062 A1 11/2018
(Continued)

OTHER PUBLICATIONS

Oct. 25, 2022 Office Action issued in Chinese Patent Application No. 201980071189.4.
(Continued)

*Primary Examiner* — Jenny R Wu
(74) *Attorney, Agent, or Firm* — Oliff PLC

(57) ABSTRACT

A high-strength steel sheet having high delayed fracture resistance and a method for manufacturing the high-strength steel sheet. The high-strength steel sheet has a specified chemical composition. Relative to the whole microstructure of the steel sheet, the total area fraction of at least one of (i) bainite containing carbide grains having an average grain size of 50 nm or less and (ii) martensite containing carbide grains having an average grain size of 50 nm or less is 90% or more. The average number of inclusions having an average grain size of 5 μm or more that are present in a section of the steel sheet perpendicular to a rolling direction is 5.0/mm$^2$ or less.

8 Claims, 1 Drawing Sheet

(51) Int. Cl.

| | |
|---|---|
| ***C21D 6/00*** | (2006.01) |
| ***C22C 38/60*** | (2006.01) |
| ***C22C 38/16*** | (2006.01) |
| ***C22C 38/14*** | (2006.01) |
| ***C22C 38/12*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/38*** | (2006.01) |
| ***C22C 38/32*** | (2006.01) |
| ***C22C 38/28*** | (2006.01) |
| ***C22C 38/26*** | (2006.01) |
| ***C22C 38/24*** | (2006.01) |
| ***C22C 38/22*** | (2006.01) |
| ***C22C 38/20*** | (2006.01) |

(52) U.S. Cl.
CPC ..... *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/60* (2013.01); *C21D 2211/002* (2013.01); *C21D 2211/004* (2013.01); *C21D 2211/008* (2013.01)

(58) Field of Classification Search
CPC .. C21D 9/00; C21D 9/30; C22C 38/00; C22C 38/001; C22C 38/002; C22C 38/02; C22C 38/04; C22C 38/06; C22C 38/20; C22C 38/22; C22C 38/24; C22C 38/26; C22C 38/28; C22C 38/40; C22C 38/60; C23C 8/02; C23C 8/26; C23C 8/38; C23C 8/50
See application file for complete search history.

(56) References Cited

U.S. PATENT DOCUMENTS

| | | | | |
|---|---|---|---|---|
| 2018/0100212 | A1 | 4/2018 | Ono et al. | |
| 2019/0017156 | A1* | 1/2019 | Kawamura | C23C 2/06 |
| 2019/0194775 | A1 | 6/2019 | Ono et al. | |
| 2019/0203317 | A1* | 7/2019 | Yoshioka | C23C 2/28 |
| 2020/0094525 | A1* | 3/2020 | Abukawa | C22C 38/001 |

FOREIGN PATENT DOCUMENTS

| | | | | |
|---|---|---|---|---|
| EP | 3486346 | A1 | 5/2019 | |
| EP | 3572543 | A1 | 11/2019 | |
| JP | 2003-166035 | A | 6/2003 | |
| JP | 2011-246746 | A | 12/2011 | |
| JP | 2018-080379 | A | 5/2018 | |
| WO | 2015/115059 | A1 | 8/2015 | |
| WO | 2016/152163 | A1 | 9/2016 | |
| WO | WO-2017115748 | A1 * | 7/2017 | B21B 3/00 |
| WO | 2018/062380 | A1 | 4/2018 | |
| WO | 2018/062381 | A1 | 4/2018 | |
| WO | WO-2018062381 | A1 * | 4/2018 | C21D 1/18 |
| WO | 2018/127948 | A1 | 7/2018 | |
| WO | 2018127984 | A1 | 7/2018 | |
| WO | 2018134872 | A1 | 7/2018 | |

OTHER PUBLICATIONS

Dec. 17, 2019 International Search Report issued in International Application No. PCT/JP2019/037689.
May 16, 2022 Office Action issued in Chinese Patent Application No. 201980071189.4.
Aug. 31, 2021 Extended European Search Report issued in European Patent Application No. 19878653.5.
Nov. 18, 2021 Office Action issued in Chinese Patent Application No. 201980071189.4.
Oct. 1, 2022 Office Action issued in Korean Patent Application No. 10-2021-7012528.
Mar. 29, 2023 Office Action issued in Korean Patent Application No. 10-2021-7012528.

* cited by examiner

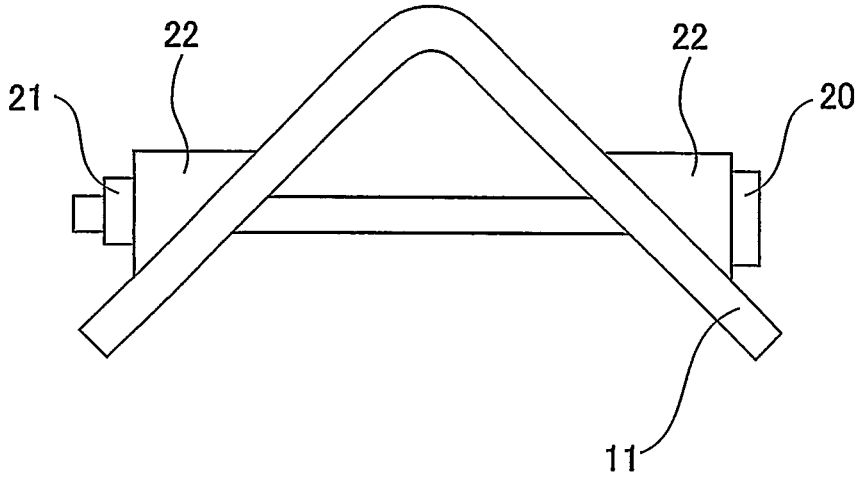
22
22
21
20
11

HIGH-STRENGTH STEEL SHEET AND METHOD FOR MANUFACTURING THE SAME

TECHNICAL FIELD

This application relates to a high-strength steel sheet used, for example, for automobile parts and a method for manufacturing the high-strength steel sheet. More particularly, the application relates to a high-strength steel sheet having high delayed fracture resistance and a method for manufacturing the high-strength steel sheet.

BACKGROUND

In recent years, high-strength steel sheets of 1320 to 1470 MPa grade in tensile strength (TS) have been increasingly vehicle body frame parts such as center pillar R/F (reinforcement), bumpers, impact beam parts, and the like (hereinafter also referred to as "parts"). Furthermore, in view of further weight reduction of automobile bodies, the application of steel sheets of 1800 MPa (1.8 GPa) grade or higher in TS to for parts therefor has also been investigated.

As the strength of steel sheets increased, the occurrence of delayed fracture becomes a concern. In recent years, delayed fracture of a sample processed into a part shape, particularly delayed fracture originating from a sheared edge surface of a bent portion where strains are concentrated, has been of concern. Accordingly, it is important to suppress such delayed fracture originating from a sheared edge surface.

For example, Patent Literature 1 provides a steel sheet that is made of a steel having a chemical composition satisfying C: 0.05% to 0.3%, Si: 3.0% or less, Mn: 0.01% to 3.0%, P: 0.02% or less, S: 0.02% or less, Al: 3.0% or less, and N: 0.01% or less, with the balance being Fe and unavoidable impurities, and that exhibits excellent delayed fracture resistance after forming by specifying the grain size and density of Mg oxide, sulfide, complex crystallized product, and a complex precipitate.

CITATION LIST

Patent Literature

PTL 1: Japanese Unexamined Patent Application Publication No. 2003-166035

SUMMARY

Technical Problem

The technique disclosed in Patent Literature 1 provides a steel sheet having excellent delayed fracture resistance by specifying the chemical composition and the grain size and density of the precipitated product in the steel. However, due to the small amount of added C, the steel sheet in Patent Literature 1 has a lower strength than a high-strength steel sheet according to the disclosed embodiments and has TS of less than 1470 MPa. In the steel sheet of Patent Literature 1, it is presumed that even if the strength is increased by, for example, increasing the amount of C, delayed fracture resistance deteriorates since the residual stress of an edge surface also increased as the strength increases.

The disclosed embodiments have been made in view of the above circumstances, and an object thereof is to provide a high-strength steel sheet having excellent delayed fracture resistance and a method for manufacturing the high-strength steel sheet.

In the disclosed embodiments, "high strength" means having a tensile strength (TS) of 1470 MPa or more.

In the disclosed embodiments, "excellent delayed fracture resistance" means that a critical load stress is equal to or higher than a yield strength (YS). As described in the EXAMPLES, the critical load stress is measured as the maximum load stress without a delayed fracture when a member obtained by bending a steel sheet is immersed in hydrochloric acid at pH of 1 (25° C.).

Solution to Problem

To achieve the above object, the present inventors have conducted intensive studies and found that when a steel sheet has a predetermined element composition and a predetermined microstructure composed mainly of martensite and bainite, and the average number of inclusions having an average grain size of 5 μm or more that are present in a section perpendicular to a rolling direction is 5.0/mm$^2$ or less, the steel sheet can be a high-strength steel sheet having excellent delayed fracture resistance, thereby accomplishing the disclosed embodiments. The above object can be achieved by the following means.

[1] A high-strength steel sheet which comprises:
- an element composition containing, by mass %:
  - C: 0.17% or more and 0.35% or less;
  - Si: 0.001% or more and 1.2% or less;
  - Mn: 0.9% or more and 3.2% or less;
  - P: 0.02% or less;
  - S: 0.001% or less;
  - Al: 0.01% or more and 0.2% or less; and
  - N: 0.010% or less, the balance being Fe and unavoidable impurities, wherein:
- relative to a whole microstructure of the steel sheet, a total area fraction of one or two of bainite containing carbide grains having an average grain size of 50 nm or less and martensite containing carbide grains having an average grain size of 50 nm or less is 90% or more; and
- an average number of inclusions having an average grain size of 5 μm or more that are present in a section perpendicular to a rolling direction is 5.0/mm$^2$ or less.

[2] A high-strength steel sheet which comprises:
- an element composition containing, by mass %:
  - C: 0.17% or more and 0.35% or less;
  - Si: 0.001% or more and 1.2% or less;
  - Mn: 0.9% or more and 3.2% or less;
  - P: 0.02% or less;
  - S: 0.001% or less;
  - Al: 0.01% or more and 0.2% or less;
  - N: 0.010% or less, and
  - Sb: 0.001% or more and 0.1% or less, the balance being Fe and unavoidable impurities, wherein:
- relative to a whole microstructure of the steel sheet, a total area fraction of one or two of bainite containing carbide grains having an average grain size of 50 nm or less and martensite containing carbide grains having an average grain size of 50 nm or less is 90% or more; and
- an average number of inclusions having an average grain size of 5 μm or more that are present in a section perpendicular to a rolling direction is 5.0/mm$^2$ or less.

[3] In the high-strength steel sheet according to [1] or [2], the element composition further contains, by mass %:
B: 0.0002% or more and less than 0.0035%.

[4] In the high-strength steel sheet according to any one of [1] to [3], the element composition further contains, by mass %, at least one selected from:
Nb: 0.002% or more and 0.08% or less; and
Ti: 0.002% or more and 0.12% or less.

[5] In the high-strength steel sheet according to any one of [1] to [4], the element composition further contains, by mass %, at least one selected from:
Cu: 0.005% or more and 1% or less; and
Ni: 0.005% or more and 1% or less.

[6] In the high-strength steel sheet according to any one of [1] to [5], the element composition further contains, by mass %, at least one selected from:
Cr: 0.01% or more and 1.0% or less;
Mo: 0.01% or more and less than 0.3%;
V: 0.003% or more and 0.5% or less;
Zr: 0.005% or more and 0.20% or less; and
W: 0.005% or more and 0.20% or less.

[7] In the high-strength steel sheet according to any one of [1] to [6], the element composition further contains, by mass %, at least one selected from:
Ca: 0.0002% or more and 0.0030% or less;
Ce: 0.0002% or more and 0.0030% or less;
La: 0.0002% or more and 0.0030% or less; and
Mg: 0.0002% or more and 0.0030% or less.

[8] In the high-strength steel sheet according to any one of [1] to [7], the element composition further contains, by mass %:
Sn: 0.002% or more and 0.1% or less.

[9] A method for manufacturing a high-strength steel sheet which comprises:

a hot rolling step including casting a steel having the element composition according to any one of [1] to [8] at a casting speed of 1.80 m/min or less, then hot rolling the casted the steel at a slab heating temperature of 1200° C. or higher and a finishing delivery temperature of 840° C. or higher, and coiling the hot-rolled steel sheet at a coiling temperature of 630° C. or lower;

a cold rolling step including cold rolling a hot-rolled steel sheet obtained by the hot rolling step; and an annealing step includes heating a cold-rolled steel sheet obtained by the cold rolling step to an annealing temperature of $A_{C3}$ point or higher, then cooling the cold-rolled steel sheet to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for 20 seconds or more and 1500 seconds or less.

Advantageous Effects

According to the disclosed embodiments, a high-strength steel sheet having excellent delayed fracture resistance and a method for manufacturing the high-strength steel sheet can be provided. By using the high-strength steel sheet according to the disclosed embodiments as an automotive structural member, an automotive steel sheet having both increased strength and improved delayed fracture resistance can be achieved. That is, the disclosed embodiments enhance the performance of automobile bodies.

BRIEF DESCRIPTION OF THE DRAWINGS

FIG. 1 is a side view illustrating how a steel sheet subjected to bending is tightened with a bolt and a nut in the EXAMPLES.

DETAILED DESCRIPTION

Hereinafter, embodiments will be described. However, it will be understood that the disclosure is not intended to be limited to the following specific embodiments.

First, an element composition of a high-strength steel sheet will be described. In the following description of the element composition, "%", which is the unit of the content of each element, means "mass %".

<C: 0.17% or More and 0.35% or Less>

C is an element that improves hardenability. To achieve a predetermined total area fraction of one or two of martensite and bainite and also increase the strength of martensite and bainite to achieve TS≥1470 MPa, C content is 0.17% or more, preferably 0.18% or more, more preferably 0.19% or more. However, if C content is more than 0.35%, the occurrence of cracks is promoted by bending, thus degrading delayed fracture resistance. Therefore, C content is 0.35% or less, preferably 0.33% or less, more preferably 0.31% or less.

<Si: 0.001% or More and 1.2% or Less>

Si is an element for strengthening through solid-solution strengthening. When a steel sheet is held in a temperature range of 200° C. or higher, Si suppresses excessive formation of coarse carbide grains to contribute to improvement of elongation. Furthermore, Si also reduces Mn segregation at a central portion in the thickness direction to contribute to suppression of MnS formation. To sufficiently produce the above-described effects, Si content is 0.001% or more, preferably 0.003% or more, more preferably 0.005% or more. However, if Si content is excessively high, coarse MnS is readily formed in the thickness direction, and the occurrence of cracks during bending is promoted, thus degrading delayed fracture resistance. Therefore, the Si content is 1.2% or less, preferably 1.1% or less, more preferably 1.0% or less.

<Mn: 0.9% or More and 3.2% or Less>

Mn is contained to improve the hardenability of steel and achieve the predetermined total area fraction of one or two of martensite and bainite. If Mn content is less than 0.9%, ferrite is formed in a surface layer portion of the steel sheet to reduce strength. Therefore, Mn content is 0.9% or more, preferably 1.0% or more, more preferably 1.1% or more. In order not to increase MnS and promote the occurrence of cracks during bending, Mn content is 3.2% or less, preferably 3.1% or less, more preferably 3.0% or less.

<P: 0.02% or Less>

P is an element that strengthens steel, but if the content thereof is high, the occurrence of cracks is promoted, thus degrading delayed fracture resistance. Therefore, P content is 0.02% or less, preferably 0.015% or less, more preferably 0.01% or less. The lower limit of P content is not particularly limited, however, the lower limit that is industrially feasible at present is about 0.003%.

<S: 0.001% or Less>

S forms inclusions such as MnS, TiS, and Ti(C, S). To suppress the occurrence of cracks due to these inclusions, the S content needs to be 0.001% or less. The S content is preferably 0.0009% or less, more preferably 0.0007% or less, still more preferably 0.0005% or less. The lower limit of S content is not particularly limited, however, the lower limit that is industrially feasible at present is about 0.0002%.

<Al: 0.01% or More and 0.2% or Less>

Al is added to achieve sufficient deoxidization and reduce coarse inclusions in steel. To produce these effects, Al content is 0.01% or more, preferably 0.015% or more. However, if Al content is more than 0.2%, Fe-based carbide grains, such as cementite, formed during coiling subsequent to hot rolling, are less likely to dissolve in an annealing step, and coarse inclusions or carbide grains are formed, thus promoting occurrence of cracks to degrade delayed fracture resistance. In addition, inclusions of AlN are excessively formed. Therefore, Al content is 0.2% or less, preferably 0.17% or less, more preferably 0.15% or less.

<N: 0.010% or Less>

N is an element that forms coarse nitride and carbonitride inclusions, such as TiN, (Nb, Ti) (C, N), and AlN, in steel, and the occurrence of cracks is promoted through the formation of these coarse inclusions. To prevent degradation of delayed fracture resistance, N content is 0.010% or less, preferably 0.007% or less, more preferably 0.005% or less. The lower limit of N content is not particularly limited, however, the lower limit that is industrially feasible at present is about 0.0006%.

<Sb: 0.001% or More and 0.1% or Less>

Sb suppresses oxidation and nitridation of the surface layer portion of the steel sheet to suppress decarburization, which may be caused due to oxidation and nitridation of the surface layer portion of the steel sheet. The suppression of decarburization suppresses the formation of ferrite in the surface layer portion of the steel sheet to contribute to an increase in strength. Furthermore, the suppression of decarburization also improves delayed fracture resistance. From this viewpoint, Sb content is preferably 0.001% or more, more preferably 0.002% or more, still more preferably 0.003% or more. However, Sb contained in an amount more than 0.1% may segregate at prior-austenite (γ) grain boundaries to promote the occurrence of cracks, thus degrading delayed fracture resistance. Thus, Sb content is preferably 0.1% or less, more preferably 0.08% or less, still more preferably 0.06% or less. Although Sb is preferably contained, if the effect of increasing the strength and delayed fracture resistance of the steel sheet can be sufficiently produced without Sb, Sb need not be contained.

Preferably, the steel of the disclosed embodiments basically contains the above elements, with the balance being iron and unavoidable impurities, and the following allowable elements may be contained to the extent that the advantageous effects of the disclosed embodiments are not impaired.

<B: 0.0002% or More and Less Than 0.0035%>

B is an element that improves the hardenability of steel and has the advantage of forming martensite and bainite with predetermined area fractions even when the Mn content is low. To produce these effects of B, B content is preferably 0.0002% or more, more preferably 0.0005% or more, still more preferably 0.0007% or more. To fix N, B is preferably added in combination with 0.002% or more of Ti. However, if B content is 0.0035% or more, the dissolution rate of cementite during annealing is retarded, and Fe-based carbide grains, such as undissolved cementite, remain. As a result, coarse inclusions and the carbide grains are formed, thus promoting the occurrence of cracks to degrade delayed fracture resistance. Therefore, the B content is preferably less than 0.0035%, more preferably 0.0030% or less, still more preferably 0.0025% or less.

<At Least One Selected from Nb: 0.002% or More and 0.08% or Less and Ti: 0.002% or More and 0.12% or Less>

Nb and Ti contribute to an increase in strength through refinement of prior-austenite (γ) grains. From this viewpoint, the Nb content and the Ti content are each preferably 0.002% or more, more preferably 0.003% or more, still more preferably 0.005% or more. However, if Nb and Ti are contained in large amounts, the amount of coarse Nb precipitates, such as NbN, Nb(C, N), and (Nb, Ti) (C, N), and coarse Ti precipitates, such as TiN, Ti(C, N), Ti(C, S), and TiS, remaining undissolved during slab heating in a hot rolling step increases to promote the occurrence of cracks, thus degrading delayed fracture resistance. Thus, the Nb content is preferably 0.08% or less, more preferably 0.06% or less, still more preferably 0.04% or less. The Ti content is preferably 0.12% or less, more preferably 0.10% or less, still more preferably 0.08% or less.

<At Least One Selected from Cu: 0.005% or More and 1% or Less and Ni: 0.005% or More and 1% or Less>

Cu and Ni improve corrosion resistance of automobiles under service conditions, and corrosion products thereof cover the surface of the steel sheet to inhibit hydrogen entry into the steel sheet. From the viewpoint of improvement in delayed fracture resistance, Cu and Ni are more preferably contained each in an amount of 0.005% or more, still more preferably 0.008% or more. However, excessively large amounts of Cu and Ni induce the occurrence of surface defects to degrade coatability and chemical convertibility, and thus the Cu content and the Ni content are each preferably 1% or less, more preferably 0.8% or less, still more preferably 0.6% or less.

<At Least One Selected from Cr: 0.01% or More and 1.0% or Less, Mo: 0.01% or More and Less Than 0.3%, V: 0.003% or More and 0.5% or Less, Zr: 0.005% or More and 0.20% or Less, and W: 0.005% or More and 0.20% or Less>

Cr, Mo, and V can be contained for the purpose of improving the hardenability of steel. To produce this effect, Cr content and Mo content are each preferably 0.01% or more, more preferably 0.02% or more, still more preferably 0.03% or more. The V content is preferably 0.003% or more, more preferably 0.005% or more, still more preferably 0.007% or more. However, these elements, if contained excessively, each form coarse carbide grains to promote the occurrence of cracks and degrade delayed fracture resistance. Thus, Cr content is preferably 1.0% or less, more preferably 0.4% or less, still more preferably 0.2% or less. The Mo content is preferably less than 0.3%, more preferably 0.2% or less, still more preferably 0.1% or less. The V content is preferably 0.5% or less, more preferably 0.4% or less, still more preferably 0.3% or less.

Zr and W contribute to an increase in strength through refinement of prior-austenite (γ) grains. From this viewpoint, Zr content and W content are each preferably 0.005% or more, more preferably 0.006% or more, still more preferably 0.007% or more. However, if Zr and W are contained in large amounts, the amount of coarse precipitates remaining undissolved during slab heating in the hot rolling step increases to promote the occurrence of cracks, thus degrading delayed fracture resistance. Thus, Zr content and W content are each preferably 0.20% or less, more preferably 0.15% or less, still more preferably 0.10% or less.

<At Least One Selected from Ca: 0.0002% or More and 0.0030% or Less, Ce: 0.0002% or More and 0.0030% or Less, La: 0.0002% or More and 0.0030% or Less, and Mg: 0.0002% or More and 0.0030% or Less>

Ca, Ce, and La form sulfides to fix S, thereby contributing to improvement in delayed fracture resistance. Thus, the contents of these elements are each preferably 0.0002% or more, more preferably 0.0003% or more, still more preferably 0.0005% or more. However, these elements, if added in large amounts, form coarse sulfides to promote the occurrence of cracks and degrade delayed fracture resistance. Therefore, the contents of these elements are each preferably 0.0030% or less, more preferably 0.0020% or less, still more preferably 0.0010% or less.

Mg forms MgO to fix O and serves as a site for trapping hydrogen in steel, thus contributing to improvement in delayed fracture resistance. Thus, the Mg content is preferably 0.0002% or more, more preferably 0.0003% or more, still more preferably 0.0005% or more. However, Mg, if added in a large amount, forms coarse MgO to promote the occurrence of cracks and degrade delayed fracture resistance, and thus the Mg content is preferably 0.0030% or less, more preferably 0.0020% or less, still more preferably 0.0010% or less.

<Sn: 0.002% or More and 0.1% or Less>

Sn suppresses oxidation and nitridation of the surface layer portion of the steel sheet to suppress decarburization, which may be caused due to oxidation and nitridation of the surface layer portion of the steel sheet. The suppression of decarburization suppresses the formation of ferrite in the surface layer portion of the steel sheet to contribute to an increase in strength. From this viewpoint, the Sn content is preferably 0.002% or more, more preferably 0.003% or more, still more preferably 0.004% or more. However, Sn contained in an amount more than 0.1% segregates at prior-austenite (γ) grain boundaries to promote the occurrence of cracks, thus degrading delayed fracture resistance. Thus, the Sn content is preferably 0.1% or less, more preferably 0.08% or less, still more preferably 0.06% or less.

Next, a microstructure of the high-strength steel sheet according to the disclosed embodiments will be described.

<Relative to Whole Microstructure of Steel Sheet, Total Area Fraction of One or Two of Bainite Containing Carbide Grains Having Average Grain Size of 50 nm or Less and Martensite Containing Carbide Grains Having Average Grain Size of 50 nm or Less is 90% or More>

To achieve a high strength satisfying TS≥1470 MPa, relative to the whole microstructure of the steel sheet, the total area fraction of one or two of bainite containing carbide grains having an average grain size of 50 nm or less and martensite containing carbide grains having an average grain size of 50 nm or less is 90% or more. When the total area fraction is less than 90%, the amount of ferrite increases to reduce strength. The total area fraction of martensite and bainite relative to the whole microstructure may be 100%. The area fraction of one of martensite and bainite may be within the above range, or the total area fraction of the both may be within the above range. To increase strength, the area fraction is preferably 91% or more, more preferably 92% or more, still more preferably 93% or more.

Martensite is regarded as the total of as-quenched martensite and tempered martensite that has been tempered. In the disclosed embodiments, martensite refers to a hard microstructure that is produced from austenite at a low temperature (martensite transformation temperature or lower), and tempered martensite refers to a microstructure that is tempered when martensite is reheated. Bainite refers to a hard microstructure that is produced from austenite at a relatively low temperature (not lower than the martensite transformation temperature) and is formed of acicular or plate-like ferrite and fine carbide grains dispersed therein.

The balance microstructure other than martensite and bainite includes ferrite, pearlite, and retained austenite, and the acceptable total amount thereof is 10% or less. The total amount may be 0%.

In the disclosed embodiments, ferrite is a microstructure that is produced through transformation from austenite at a relatively high temperature and is formed of crystal grains with the bcc lattice; pearlite is a microstructure in which ferrite and cementite are formed in layers; and retained austenite is an austenite that has not been transformed into martensite as the martensite transformation temperature is decreased to room temperature or lower.

As used herein, the carbide grains having an average grain size of 50 nm or less are fine carbide grains that can be observed in bainite and martensite under a scanning electron microscope (SEM), and specific examples include Fe carbide grains, Ti carbide grains, V carbide grains, Mo carbide grains, W carbide grains, Nb carbide grains, and Zr carbide grains.

The steel sheet according to the disclosed embodiments may include a coating layer such as a hot-dip zinc-coating layer. The coating layer may be, for example, an electroplated coating layer, an electroless plated coating layer, or a hot-dip coating layer. The coating layer may also be an alloyed coating layer.

<Average Number of Inclusions Having Average Grain Size of 5 μm or More That Are Present in Section Perpendicular to Rolling Direction is 5.0/mm$^2$ or Less>

To obtain a steel sheet having good delayed fracture resistance, the average number of inclusions having an average grain size of 5 μm or more that are present in a section perpendicular to a rolling direction needs to be 5.0/mm$^2$ or less. A delayed fracture that occurs from an edge surface formed by cutting a steel sheet proceeds from a microcrack in the edge surface, and the microcrack occurs at a boundary between a parent phase and inclusions. If the average grain size of the inclusions is 5 μm or more, the occurrence of microcracks becomes pronounced. Therefore, reducing inclusions having an average grain size of 5 μm or more leads to an improvement in delayed fracture resistance. Therefore, the average number of inclusions having an average grain size of 5 μm or more is 5.0/mm$^2$ or less, preferably 4.0/mm$^2$ or less, more preferably 3.0/mm$^2$ or less. The lower limit is not particularly limited and may be 0/mm$^2$.

As used herein, the inclusions having an average grain size of 5 μm or more are crystalline substances present in the parent phase when the steel sheet is cut in a direction perpendicular to the rolling direction. The inclusions can be observed using an optical microscope as described in the EXAMPLES. Specifically, for example, the inclusions are often MnS or AlN. The average grain size can be determined by a method described in the EXAMPLES.

Next, a method for manufacturing a high-strength steel sheet according to an embodiment will be described.

The method for manufacturing a high-strength steel sheet according to an embodiment includes at least a casting step, a hot rolling step, a cold rolling step, and an annealing step. More specifically, the method for manufacturing a high-strength steel sheet according to an embodiment includes a hot rolling step of casting a steel having the above-described element composition at a casting speed of 1.80 m/min or less, then performing hot rolling at a slab heating temperature of 1200° C. or higher and a finishing delivery temperature of 840° C. or higher, and performing coiling at a coiling temperature of 630° C. or lower; a cold rolling step of cold rolling a hot-rolled steel sheet obtained in the hot rolling step; and an annealing step of heating a cold-rolled steel sheet obtained in the cold rolling step to an annealing temperature of $A_{C3}$ point or higher, then performing cooling to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for 20 seconds or more and 1500 seconds or less. The steps will each be described below. Temperatures given below mean surface temperatures of slabs, steel sheets, and the like.

[Casting Step]

A steel having the above-described element composition is cast at a casting speed of 1.80 m/min or less. The casting speed has a great influence on the amount of formed inclusions, which degrade delayed fracture resistance. As the casting speed increases, the amount of formed inclusions increases, and as a result, the average number of inclusions having an average grain size of 5 μm or more that are present in a section perpendicular to a rolling direction cannot be 5.0/mm$^2$ or less. Therefore, to suppress the formation of inclusions, the casting speed is 1.80 m/min or less, preferably 1.75 m/min or less, more preferably 1.70 m/min or less. The lower limit is not particularly limited, and is preferably 1.25 m/min or more, more preferably 1.30 m/min or more, from the viewpoint of productivity.

[Hot Rolling Step]

The steel slab having the above-described element composition is subjected to hot rolling. A slab heating temperature of 1200° C. or higher facilitates sulfide dissolution and reduces Mn segregation, thus reducing the amount of the above-described coarse inclusions to improve delayed fracture resistance. Thus, the slab heating temperature is 1200° C. or higher, preferably 1220° C. or higher, more preferably 1240° C. or higher. The upper limit of the slab heating temperature is not particularly limited, and is preferably 1400° C. or lower. To inhibit the growth of inclusions, the heating rate during slab heating is preferably 5° C./min to 15° C./min, and the slab soaking time is preferably 30 to 100 minutes.

The finishing delivery temperature is 840° C. or higher. If the finishing delivery temperature is lower than 840° C., it takes time for the temperature to decrease, and inclusions are formed, which degrades delayed fracture resistance and may also degrade the quality inside the steel sheet. Therefore, the finishing delivery temperature is 840° C. or higher, preferably 860° C. or higher. The upper limit is not particularly limited, but for reasons of difficulty in subsequent cooling to a coiling temperature, the finishing delivery temperature is preferably 950° C. or lower, more preferably 920° C. or lower.

The hot-rolled steel sheet that has been cooled is coiled at a temperature of 630° C. or lower. If the coiling temperature is higher than 630° C., the surface of a steel substrate may be decarburized to produce a microstructure difference between the inside and the surface of the steel sheet, thus resulting in uneven alloy concentration. The decarburization of the surface layer reduces the area fractions of bainite and martensite containing carbide grains in the surface layer of the steel sheet, thus making it difficult to achieve the desired strength. Therefore, the coiling temperature is 630° C. or lower, preferably 600° C. or lower. The lower limit of the coiling temperature is not particularly limited, and is preferably 500° C. or higher to prevent a reduction in cold rolling properties.

[Cold Rolling Step]

In the cold rolling step, the coiled hot-rolled steel sheet is pickled and then cold rolled to produce a cold-rolled steel sheet. The conditions of the pickling are not particularly limited. In the case of a rolling reduction of less than 20%, the flatness of the surface may be poor to form an uneven microstructure, and thus the rolling reduction is preferably 20% or more, more preferably 30% or more, still more preferably 40% or more.

[Annealing Step]

The cold-rolled steel sheet subjected to cold rolling is heated to an annealing temperature of $A_{C3}$ point or higher. If the annealing temperature is lower than the $A_{C3}$ point, ferrite is formed in a microstructure, thus failing to provide the desired strength. Therefore, the annealing temperature is $A_{C3}$ point or higher, preferably ($A_{C3}$ point+10° C.) or higher, more preferably ($A_{C3}$ point+20° C.) or higher. The upper limit of the annealing temperature is not particularly limited, and to suppress coarsening of austenite and prevent degradation of delayed fracture resistance, the annealing temperature is preferably 900° C. or lower.

After being heated to an annealing temperature of $A_{C3}$ point or higher, the cold-rolled steel sheet may be soaked at the annealing temperature. To allow the transformation from ferrite to austenite to proceed sufficiently, the soaking time is preferably 10 seconds or more.

The $A_{C3}$ point is calculated by the following formula. In the following formula, (% element symbol) means a content (mass %) of each element.

$$A_{C3}\text{ point (° C.)}=910-203\sqrt{(\%\ C)}+45(\%\ Si)-30(\%\ Mn)-20(\%\ Cu)-15(\%\ Ni)+11(\%\ Cr)+32(\%\ Mo)+104(\%\ V)+400(\%\ Ti)+460(\%\ Al)$$

After the cold-rolled steel sheet is heated to an annealing temperature of $A_{C3}$ point or higher as described above, cooling is performed to a cooling stop temperature of 350° C. or lower at the average cooling rate of 3° C./s or more in the temperature range from the annealing temperature to 550° C., and then the cold-rolled steel sheet is held in the temperature range of 100° C. or higher and 260° C. or lower for 20 seconds or more and 1500 seconds or less.

If the average cooling rate in the temperature range from the annealing temperature to 550° C. is less than 3° C./s, ferrite is excessively formed, thus making it difficult to achieve the desired strength. The formation of ferrite in the surface layer makes it difficult to achieve the fractions of bainite and martensite containing carbide grains in the vicinity of the surface layer, thus degrading delayed fracture resistance. Therefore, the average cooling rate in the temperature range from the annealing temperature to 550° C. is 3° C./s or more, preferably 5° C./s or more, more preferably 10° C./s or more.

Unless otherwise specified, the average cooling rate in the temperature range from the annealing temperature to 550° C. is given by "(annealing temperature−550° C.)/(cooling time from annealing temperature to 550° C.)".

The average cooling rate in the temperature range from 550° C. to 350° C. is not particularly limited, and is preferably 1° C./s or more to suppress the formation of bainite containing coarse carbide grains.

Unless otherwise specified, the average cooling rate in the temperature range from 550° C. to 350° C. is given by "(550° C.−350° C.)/(cooling time from 550° C. to 350° C.)".

The cooling stop temperature is 350° C. or lower. If the cooling stop temperature is higher than 350° C., tempering does not proceed sufficiently, and as-quenched martensite containing no carbide grains and retained austenite are excessively formed in a final microstructure to reduce the amount of fine carbide grains in the surface layer of the steel sheet, thus degrading delayed fracture resistance. Therefore, to achieve high delayed fracture resistance, the cooling stop temperature is 350° C. or lower, preferably 300° C. or lower, more preferably 250° C. or lower.

The carbide grains distributed inside bainite are carbide grains formed during the holding in the low temperature range after quenching. The carbide grains can serve as hydrogen trapping sites to trap hydrogen, thereby preventing degradation of delayed fracture resistance. If the holding temperature is lower than 100° C., or if the holding time is less than 20 seconds, bainite is not formed, and as-quenched martensite containing no carbide grains is formed. As a result, the amount of fine carbide grains in the surface layer of the steel sheet is reduced, and the above-described effects cannot be produced.

If the holding temperature is higher than 260° C., or if the holding time is more than 1500 seconds, decarburization occurs, and furthermore, coarse carbide grains are formed inside the bainite, thus degrading delayed fracture resistance.

Therefore, the holding temperature is 100° C. or higher and 260° C. or lower, and the holding time is 20 seconds or more and 1500 seconds or less. The holding temperature is preferably 130° C. or higher and 240° C. or lower, and the holding time is preferably 50 seconds or more and 1000 seconds or less.

The hot-rolled steel sheet subjected to hot rolling may be subjected to a heat treatment for microstructure softening, and the surface of the steel sheet may be coated with, for example, Zn or Al. After the annealing and cooling, or after the coating treatment, temper rolling for shape adjustment may be performed.

EXAMPLES

The disclosed embodiments will be specifically described with reference to the following examples, but the disclosure is not limited thereto.

1. Production of Steel Sheet for Evaluation

Steels having element compositions shown in Table 1, with the balance being Fe and unavoidable impurities, were smelted in a vacuum melting furnace at various casting speeds and then slabbed to obtain slabbed materials having a thickness of 27 mm. The obtained slabbed materials were hot rolled to a thickness of 4.0 to 2.8 mm to produce hot-rolled steel sheets. The hot-rolled steel sheets were then cold rolled to a thickness of 1.4 mm to produce cold-rolled steel sheets. The cold-rolled steel sheets thus obtained were then subjected to heat treatments under the conditions shown in Tables 2 to 4 (annealing step). A blank in the element composition column of Table 1 means that the element is not added on purpose, including not only the case where the element is not contained (0 mass %) but also the case where the element is unavoidably contained. Details of the conditions of the casting step, the hot rolling step, the cold rolling step, and the annealing step are shown in Tables 2 to 4.

The heat-treated steel sheet was sheared into small pieces of 30 mm×110 mm, and using some of the samples, an edge surfaces formed as a result of the shearing were trimmed by laser or grinding before bending. The samples were then subjected to bending and tightened using a bolt with tightening forces corresponding to various load stresses. A sample steel sheet was placed on a die having an angle of 90° and pressed with a punch having an angle of 90° to perform V-bending. Next, using a bolt 20, a nut 21, and a taper washer 22, as illustrated in a side view of FIG. 1, the steel sheet subjected to bending was tightened with the bolt 20 from both sides of a sheet surface of a steel sheet 11. The relationship between the load stresses and the tightening forces was calculated by computer aided engineering (CAE) analysis such that the tightening forces correspond to critical load stresses. The critical load stresses were measured by a method described below.

TABLE 1

| Steel | Element composition (mass %) | | | | | | | | | |
|---|---|---|---|---|---|---|---|---|---|---|
| type | C | Si | Mn | P | S | Al | N | Sb | Others | $A_{c3}$ point (° C.) |
| A | 0.21 | 0.20 | 1.2 | 0.007 | 0.0008 | 0.05 | 0.0021 | 0.01 | | 813 |
| B | 0.31 | 0.20 | 1.2 | 0.008 | 0.0003 | 0.07 | 0.0048 | 0.01 | | 801 |
| C | 0.17 | 0.20 | 2.8 | 0.008 | 0.0005 | 0.08 | 0.0021 | 0.02 | | 788 |
| D | 0.34 | 0.90 | 1.1 | 0.018 | 0.0002 | 0.02 | 0.0043 | 0.01 | | 809 |
| E | 0.18 | 0.02 | 1.8 | 0.010 | 0.0010 | 0.08 | 0.0043 | 0.01 | | 806 |
| F | 0.19 | 0.85 | 3.0 | 0.010 | 0.0010 | 0.05 | 0.0058 | 0.04 | | 792 |
| G | 0.28 | 1.15 | 1.1 | 0.007 | 0.0004 | 0.04 | 0.0014 | 0.01 | | 838 |
| H | 0.29 | 0.30 | 1.0 | 0.007 | 0.0010 | 0.08 | 0.0034 | 0.02 | | 820 |
| I | 0.23 | 0.12 | 3.2 | 0.006 | 0.0007 | 0.10 | 0.0046 | 0.03 | | 766 |
| J | 0.31 | 0.40 | 1.2 | 0.015 | 0.0002 | 0.09 | 0.0028 | 0.01 | | 821 |
| K | 0.32 | 0.38 | 1.2 | 0.009 | 0.0009 | 0.03 | 0.0031 | 0.005 | | 788 |
| L | 0.22 | 0.01 | 2.7 | 0.016 | 0.0004 | 0.04 | 0.0028 | 0.003 | B: 0.0020 | 752 |
| M | 0.23 | 0.07 | 2.8 | 0.005 | 0.0004 | 0.05 | 0.0015 | 0.07 | B: 0.0032 | 755 |
| N | 0.22 | 0.21 | 2.8 | 0.006 | 0.0010 | 0.07 | 0.0053 | 0.09 | B: 0.0004 | 771 |
| O | 0.23 | 0.30 | 2.9 | 0.018 | 0.0006 | 0.05 | 0.0040 | 0.01 | Nb: 0.0150 | 763 |
| P | 0.26 | 0.09 | 1.7 | 0.006 | 0.0002 | 0.06 | 0.0027 | 0.01 | Nb: 0.0700 | 788 |
| Q | 0.24 | 0.75 | 2.4 | 0.009 | 0.0002 | 0.06 | 0.0051 | 0.05 | Nb: 0.0025 | 801 |
| R | 0.24 | 0.11 | 2.5 | 0.007 | 0.0004 | 0.04 | 0.0051 | 0.01 | Ti: 0.017 | 765 |
| S | 0.25 | 0.10 | 2.3 | 0.006 | 0.0003 | 0.04 | 0.0037 | 0.01 | Ti: 0.090 | 798 |
| T | 0.26 | 0.04 | 2.2 | 0.017 | 0.0005 | 0.03 | 0.0019 | 0.06 | Ti: 0.0025 | 759 |
| U | 0.28 | 0.20 | 1.6 | 0.009 | 0.0003 | 0.10 | 0.0060 | 0.01 | Cu: 0.15 | 805 |
| V | 0.28 | 0.60 | 1.6 | 0.015 | 0.0010 | 0.10 | 0.0020 | 0.02 | Cu: 0.90 | 808 |
| W | 0.26 | 0.12 | 1.8 | 0.008 | 0.0010 | 0.07 | 0.0020 | 0.02 | Cu: 0.02 | 789 |
| X | 0.22 | 0.35 | 2.7 | 0.009 | 0.0001 | 0.06 | 0.0043 | 0.01 | B: 0.0025, Ti: 0.015, Ni: 0.12 | 780 |
| Y | 0.23 | 1.10 | 2.8 | 0.009 | 0.0009 | 0.04 | 0.0029 | 0.03 | Nb: 0.0130, Cr: 0.05, Mo: 0.05 | 800 |
| Z | 0.25 | 1.00 | 2.4 | 0.009 | 0.0007 | 0.03 | 0.0039 | 0.03 | Cu: 0.13, Cr: 0.03, V: 0.012 | 796 |

TABLE 1-continued

| Steel type | Element composition (mass %) C | Si | Mn | P | S | Al | N | Sb | Others | $A_{c3}$ point (° C.) |
|---|---|---|---|---|---|---|---|---|---|---|
| AA | 0.24 | 0.10 | 2.6 | 0.018 | 0.0010 | 0.03 | 0.0033 | 0.04 | Zr: 0.009, W:0.01, Ca: 0.0008, Ce: 0.0009, La: 0.0006, Mg: 0.0005 | 753 |
| AB | 0.27 | 0.10 | 1.8 | 0.007 | 0.0007 | 0.06 | 0.0027 | 0.01 | Sn: 0.004 | 783 |
| AC | 0.21 | 0.10 | 1.2 | 0.005 | 0.0008 | 0.05 | 0.0021 | | | 813 |
| AD | 0.26 | 0.50 | 2.2 | 0.005 | 0.0005 | 0.03 | 0.0019 | | | 759 |
| AE | 0.37 | 0.20 | 1.2 | 0.019 | 0.0002 | 0.04 | 0.0021 | 0.01 | | 776 |
| AF | 0.14 | 0.90 | 3.0 | 0.006 | 0.0002 | 0.08 | 0.0055 | 0.01 | | 820 |
| AG | 0.21 | 2.40 | 2.8 | 0.008 | 0.0010 | 0.02 | 0.0028 | 0.01 | | 852 |
| AH | 0.22 | 0.12 | 3.4 | 0.014 | 0.0006 | 0.07 | 0.0024 | 0.01 | | 750 |
| AI | 0.26 | 0.16 | 0.8 | 0.008 | 0.0007 | 0.06 | 0.0010 | 0.01 | | 817 |
| AJ | 0.28 | 0.84 | 1.4 | 0.030 | 0.0004 | 0.07 | 0.0058 | 0.01 | | 830 |
| AK | 0.26 | 0.07 | 1.5 | 0.007 | 0.0020 | 0.06 | 0.0028 | 0.01 | | 792 |
| AL | 0.25 | 0.11 | 1.6 | 0.006 | 0.0003 | 0.25 | 0.0021 | 0.01 | | 880 |
| AM | 0.21 | 0.05 | 2.9 | 0.018 | 0.0008 | 0.07 | 0.0015 | 0.15 | | 765 |
| AN | 0.18 | 0.01 | 3.0 | 0.009 | 0.0005 | 0.08 | 0.0015 | 0.02 | B: 0.0040 | 770 |
| AO | 0.25 | 0.04 | 1.8 | 0.009 | 0.0002 | 0.05 | 0.0057 | 0.02 | Nb: 0.1000 | 781 |
| AP | 0.24 | 0.15 | 2.0 | 0.006 | 0.0009 | 0.07 | 0.0054 | 0.02 | Ti: 0.140 | 846 |

TABLE 2

| | | Casting step | | | | Cold rolling step | Annealing step | | | | | |
|---|---|---|---|---|---|---|---|---|---|---|---|---|
| | | Casting | Hot rolling step | | | Rolling | Annealing | | Cooling stop | Holding | | |
| No. | Steel type | speed (m/min) | *1 (° C.) | *2 (° C.) | *3 (° C.) | reduction (%) | temperature (° C.) | *4 (° C./s) | temperature (° C.) | temperature (° C.) | Holding time (s) | Remarks |
| 1 | A | 1.65 | 1300 | 880 | 550 | 56 | 880 | 2000 | 150 | 150 | 100 | Example |
| 2 | | 1.63 | 1280 | 880 | 550 | 56 | 860 | 2000 | 150 | 200 | 100 | Example |
| 3 | | 1.66 | 1190 | 880 | 550 | 56 | 860 | 2000 | 150 | 150 | 100 | Comparative Example |
| 4 | | 1.64 | 1250 | 880 | 550 | 56 | 860 | 2000 | 150 | 150 | 100 | Example |
| 5 | | 1.68 | 1250 | 880 | 550 | 56 | 860 | 2000 | 150 | 150 | 100 | Example |
| 6 | | 1.67 | 1190 | 880 | 550 | 56 | 860 | 2000 | 150 | 150 | 100 | Comparative Example |
| 7 | B | 1.83 | 1250 | 880 | 550 | 56 | 860 | 2000 | 150 | 150 | 100 | Comparative Example |
| 8 | | 1.62 | 1250 | 880 | 550 | 56 | 860 | 2000 | 150 | 150 | 100 | Example |
| 9 | | 1.62 | 1250 | 880 | 550 | 56 | 860 | 2000 | 150 | 150 | 100 | Example |
| 10 | | 1.56 | 1250 | 880 | 550 | 56 | 860 | 2000 | 150 | 150 | 100 | Example |
| 11 | | 1.67 | 1250 | 880 | 550 | 56 | 860 | 2000 | 150 | 150 | 100 | Example |
| 12 | | 1.74 | 1250 | 880 | 550 | 56 | 860 | 2000 | 150 | 150 | 100 | Example |
| 13 | C | 1.62 | 1300 | 880 | 550 | 56 | 860 | 10 | 150 | 150 | 100 | Example |
| 14 | | 1.66 | 1280 | 880 | 550 | 56 | 860 | 10 | 150 | 150 | 100 | Example |
| 15 | | 1.65 | 1260 | 880 | 550 | 56 | 860 | 10 | 150 | 150 | 100 | Example |
| 16 | | 1.67 | 1190 | 880 | 550 | 56 | 860 | 10 | 150 | 150 | 100 | Comparative Example |
| 17 | D | 1.41 | 1250 | 880 | 550 | 56 | 860 | 2000 | 150 | 150 | 100 | Example |
| 18 | | 1.55 | 1250 | 850 | 550 | 56 | 860 | 2000 | 150 | 150 | 100 | Example |
| 19 | | 1.67 | 1250 | 840 | 550 | 56 | 860 | 2000 | 150 | 150 | 100 | Example |
| 20 | | 1.64 | 1250 | 830 | 550 | 56 | 860 | 2000 | 150 | 150 | 100 | Comparative Example |
| 21 | E | 1.86 | 1250 | 880 | 550 | 56 | 860 | 2000 | 150 | 150 | 100 | Comparative Example |
| 22 | | 1.70 | 1250 | 880 | 550 | 56 | 860 | 2000 | 150 | 150 | 100 | Example |
| 23 | | 1.68 | 1250 | 880 | 550 | 56 | 860 | 2000 | 150 | 150 | 100 | Example |
| 24 | | 1.63 | 1250 | 880 | 550 | 56 | 860 | 2000 | 150 | 150 | 100 | Example |
| 25 | | 1.84 | 1250 | 880 | 550 | 56 | 860 | 2000 | 150 | 150 | 100 | Comparative Example |
| 26 | | 1.63 | 1250 | 880 | 550 | 56 | 860 | 2000 | 150 | 150 | 100 | Example |
| 27 | F | 1.64 | 1250 | 880 | 550 | 56 | 860 | 10 | 150 | 150 | 100 | Example |
| 28 | | 1.67 | 1250 | 880 | 550 | 56 | 860 | 10 | 200 | 150 | 100 | Example |
| 29 | | 1.57 | 1250 | 880 | 550 | 56 | 860 | 10 | 250 | 150 | 100 | Example |
| 30 | | 1.66 | 1250 | 880 | 550 | 56 | 860 | 10 | 300 | 150 | 100 | Example |
| 31 | | 1.60 | 1250 | 880 | 550 | 56 | 860 | 10 | 350 | 150 | 100 | Example |
| 32 | | 1.67 | 1250 | 880 | 550 | 56 | 860 | 10 | 400 | 150 | 100 | Comparative Example |
| 33 | G | 1.63 | 1250 | 880 | 550 | 56 | 860 | 2000 | 150 | 150 | 100 | Example |
| 34 | | 1.67 | 1250 | 880 | 580 | 56 | 860 | 2000 | 150 | 150 | 100 | Example |
| 35 | | 1.62 | 1250 | 880 | 620 | 56 | 860 | 2000 | 150 | 150 | 100 | Example |

TABLE 2-continued

| No. | Steel type | Casting step: Casting speed (m/min) | Hot rolling step: *1 (° C.) | *2 (° C.) | *3 (° C.) | Cold rolling step: Rolling reduction (%) | Annealing step: Annealing temperature (° C.) | *4 (° C./s) | Cooling stop temperature (° C.) | Holding temperature (° C.) | Holding time (s) | Remarks |
|---|---|---|---|---|---|---|---|---|---|---|---|---|
| 36 | | 1.65 | 1250 | 880 | 640 | 56 | 860 | 2000 | 150 | 150 | 100 | Comparative Example |
| 37 | H | 1.63 | 1250 | 880 | 550 | 56 | 860 | 2000 | 150 | 150 | 100 | Example |
| 38 | | 1.67 | 1250 | 880 | 550 | 40 | 860 | 2000 | 150 | 150 | 100 | Example |
| 39 | | 1.66 | 1250 | 880 | 550 | 30 | 860 | 2000 | 150 | 150 | 100 | Example |
| 40 | | 1.51 | 1250 | 880 | 550 | 20 | 860 | 2000 | 150 | 150 | 100 | Example |

*1: Slab heating temperature
*2: Finishing delivery temperature
*3: Coiling temperature
*4: Average cooling rate in temperature range from annealing temperature to 550° C.

TABLE 3

| No. | Steel type | Casting step: Casting speed (m/min) | Hot rolling step: *1 (° C.) | *2 (° C.) | *3 (° C.) | Cold rolling step: Rolling reduction (%) | Annealing step: Annealing temperature (° C.) | *4 (° C./s) | Cooling stop temperature (° C.) | Holding temperature (° C.) | Holding time (s) | Remarks |
|---|---|---|---|---|---|---|---|---|---|---|---|---|
| 41 | I | 1.62 | 1250 | 880 | 550 | 56 | 900 | 10 | 150 | 150 | 100 | Example |
| 42 | | 1.65 | 1250 | 880 | 550 | 56 | 850 | 10 | 150 | 150 | 100 | Example |
| 43 | | 1.69 | 1250 | 880 | 550 | 56 | 800 | 10 | 150 | 150 | 100 | Example |
| 44 | | 1.67 | 1250 | 880 | 550 | 56 | 750 | 10 | 150 | 150 | 100 | Comparative Example |
| 45 | J | 1.62 | 1250 | 880 | 550 | 56 | 860 | 2000 | 150 | 150 | 100 | Example |
| 46 | | 1.67 | 1250 | 880 | 550 | 56 | 860 | 2000 | 200 | 150 | 100 | Example |
| 47 | | 1.66 | 1250 | 880 | 550 | 56 | 860 | 2000 | 250 | 150 | 100 | Example |
| 48 | | 1.67 | 1250 | 880 | 550 | 56 | 860 | 2000 | 300 | 150 | 100 | Example |
| 49 | | 1.45 | 1250 | 880 | 550 | 56 | 860 | 2000 | 350 | 150 | 100 | Example |
| 50 | | 1.62 | 1250 | 880 | 550 | 56 | 860 | 2000 | 400 | 150 | 100 | Comparative Example |
| 51 | K | 1.88 | 1250 | 880 | 550 | 56 | 860 | 2000 | 150 | 150 | 100 | Comparative Example |
| 52 | | 1.54 | 1250 | 880 | 550 | 56 | 860 | 2000 | 150 | 150 | 100 | Example |
| 53 | | 1.67 | 1250 | 880 | 550 | 56 | 860 | 2000 | 150 | 150 | 100 | Example |
| 54 | | 1.73 | 1250 | 880 | 550 | 56 | 860 | 2000 | 150 | 150 | 100 | Example |
| 55 | | 1.64 | 1250 | 880 | 550 | 56 | 860 | 2000 | 150 | 150 | 100 | Example |
| 56 | | 1.69 | 1250 | 880 | 550 | 56 | 860 | 2000 | 150 | 150 | 100 | Example |
| 57 | L | 1.65 | 1250 | 880 | 550 | 56 | 860 | 10 | 150 | 150 | 100 | Example |
| 58 | | 1.63 | 1250 | 880 | 550 | 56 | 800 | 10 | 150 | 150 | 100 | Example |
| 59 | | 1.65 | 1250 | 880 | 550 | 56 | 740 | 10 | 150 | 150 | 100 | Comparative Example |
| 60 | M | 1.64 | 1250 | 880 | 550 | 56 | 860 | 10 | 150 | 150 | 100 | Example |
| 61 | | 1.64 | 1250 | 880 | 550 | 56 | 860 | 8 | 150 | 150 | 100 | Example |
| 62 | | 1.64 | 1250 | 880 | 550 | 56 | 860 | 5 | 150 | 150 | 100 | Example |
| 63 | N | 1.65 | 1250 | 880 | 550 | 56 | 860 | 7 | 150 | 150 | 100 | Example |
| 64 | | 1.58 | 1250 | 880 | 550 | 56 | 860 | 3 | 150 | 150 | 100 | Example |
| 65 | | 1.66 | 1250 | 880 | 550 | 56 | 860 | 1 | 150 | 150 | 100 | Comparative Example |
| 66 | O | 1.63 | 1250 | 880 | 550 | 56 | 860 | 10 | 150 | 150 | 100 | Example |
| 67 | | 1.68 | 1250 | 880 | 550 | 56 | 860 | 10 | 180 | 150 | 100 | Example |
| 68 | | 1.66 | 1250 | 880 | 550 | 56 | 860 | 10 | 150 | 150 | 100 | Example |
| 69 | P | 1.64 | 1250 | 880 | 550 | 56 | 860 | 2000 | 150 | 150 | 100 | Example |
| 70 | | 1.67 | 1250 | 880 | 550 | 56 | 860 | 2000 | 180 | 150 | 100 | Example |
| 71 | | 1.65 | 1250 | 880 | 550 | 56 | 860 | 2000 | 200 | 150 | 100 | Example |
| 72 | Q | 1.64 | 1250 | 880 | 550 | 56 | 860 | 10 | 150 | 150 | 100 | Example |
| 73 | | 1.56 | 1250 | 880 | 550 | 56 | 860 | 10 | 150 | 100 | 100 | Example |
| 74 | | 1.64 | 1250 | 880 | 550 | 56 | 860 | 10 | 150 | 70 | 100 | Comparative Example |
| 75 | R | 1.65 | 1250 | 880 | 550 | 56 | 860 | 10 | 150 | 150 | 100 | Example |
| 76 | | 1.65 | 1250 | 880 | 550 | 56 | 860 | 10 | 150 | 220 | 100 | Example |
| 77 | | 1.43 | 1250 | 880 | 550 | 56 | 860 | 10 | 150 | 270 | 100 | Comparative Example |
| 78 | S | 1.68 | 1250 | 880 | 550 | 56 | 860 | 10 | 150 | 150 | 100 | Example |
| 79 | | 1.68 | 1250 | 880 | 550 | 56 | 860 | 10 | 150 | 150 | 80 | Example |
| 80 | | 1.66 | 1250 | 880 | 550 | 56 | 860 | 10 | 150 | 150 | 50 | Example |

*1: Slab heating temperature
*2: Finishing delivery temperature
*3: Coiling temperature
*4: Average cooling rate in temperature range from annealing temperature to 550° C.

TABLE 4

| No. | Steel type | Casting step: Casting speed (m/min) | Hot rolling step: *1 (° C.) | Hot rolling step: *2 (° C.) | Hot rolling step: *3 (° C.) | Cold rolling step: Rolling reduction (%) | Annealing step: Annealing temperature (° C.) | Annealing step: *4 (° C./s) | Annealing step: Cooling stop temperature (° C.) | Annealing step: Holding temperature (° C.) | Annealing step: Holding time (s) | Remarks |
|---|---|---|---|---|---|---|---|---|---|---|---|---|
| 81 | T | 1.65 | 1250 | 880 | 550 | 56 | 860 | 10 | 150 | 150 | 10 | Comparative Example |
| 82 | | 1.55 | 1250 | 880 | 550 | 56 | 860 | 10 | 150 | 150 | 1000 | Example |
| 83 | | 1.67 | 1250 | 880 | 550 | 56 | 860 | 10 | 150 | 150 | 1700 | Comparative Example |
| 84 | U | 1.66 | 1250 | 880 | 550 | 56 | 860 | 2000 | 150 | 150 | 100 | Example |
| 85 | | 1.62 | 1250 | 880 | 550 | 56 | 860 | 2000 | 150 | 150 | 100 | Example |
| 86 | | 1.82 | 1250 | 880 | 550 | 56 | 860 | 2000 | 150 | 150 | 100 | Comparative Example |
| 87 | V | 1.64 | 1300 | 880 | 550 | 56 | 860 | 2000 | 150 | 150 | 100 | Example |
| 88 | | 1.68 | 1250 | 880 | 550 | 56 | 860 | 2000 | 150 | 150 | 100 | Example |
| 89 | | 1.66 | 1190 | 880 | 550 | 56 | 860 | 2000 | 150 | 150 | 100 | Comparative Example |
| 90 | W | 1.66 | 1250 | 880 | 550 | 56 | 860 | 2000 | 150 | 150 | 100 | Example |
| 91 | | 1.67 | 1250 | 850 | 550 | 56 | 860 | 2000 | 150 | 150 | 100 | Example |
| 92 | | 1.65 | 1250 | 820 | 550 | 56 | 860 | 2000 | 150 | 150 | 100 | Comparative Example |
| 93 | X | 1.63 | 1250 | 880 | 550 | 56 | 860 | 10 | 150 | 150 | 100 | Example |
| 94 | | 1.68 | 1250 | 880 | 620 | 56 | 860 | 10 | 150 | 150 | 100 | Example |
| 95 | | 1.65 | 1250 | 880 | 640 | 56 | 860 | 10 | 150 | 150 | 100 | Comparative Example |
| 96 | Y | 1.85 | 1250 | 880 | 550 | 56 | 860 | 10 | 150 | 150 | 100 | Comparative Example |
| 97 | | 1.71 | 1250 | 880 | 550 | 56 | 860 | 10 | 150 | 150 | 100 | Example |
| 98 | | 1.67 | 1250 | 880 | 550 | 56 | 860 | 10 | 150 | 150 | 100 | Example |
| 99 | Z | 1.55 | 1250 | 880 | 550 | 56 | 860 | 10 | 150 | 150 | 100 | Example |
| 100 | | 1.57 | 1250 | 880 | 550 | 56 | 820 | 30 | 150 | 150 | 100 | Example |
| 101 | | 1.57 | 1250 | 880 | 550 | 56 | 780 | 50 | 150 | 150 | 100 | Comparative Example |
| 102 | AA | 1.64 | 1250 | 880 | 550 | 56 | 860 | 10 | 150 | 150 | 100 | Example |
| 103 | | 1.67 | 1250 | 880 | 550 | 56 | 860 | 10 | 200 | 150 | 100 | Example |
| 104 | | 1.67 | 1250 | 880 | 550 | 56 | 860 | 10 | 250 | 150 | 100 | Example |
| 105 | AB | 1.44 | 1250 | 880 | 550 | 56 | 860 | 2000 | 150 | 150 | 100 | Example |
| 106 | | 1.57 | 1250 | 880 | 550 | 56 | 860 | 2000 | 150 | 170 | 100 | Example |
| 107 | | 1.64 | 1250 | 880 | 550 | 56 | 860 | 2000 | 150 | 220 | 100 | Example |
| 108 | AC | 1.65 | 1250 | 880 | 550 | 56 | 860 | 1500 | 150 | 150 | 100 | Example |
| 109 | AD | 1.65 | 1250 | 880 | 550 | 56 | 860 | 1500 | 150 | 150 | 100 | Example |
| 110 | AE | 1.62 | 1250 | 880 | 550 | 56 | 860 | 2000 | 150 | 150 | 100 | Comparative Example |
| 111 | AF | 1.62 | 1250 | 880 | 550 | 56 | 860 | 10 | 150 | 150 | 100 | Comparative Example |
| 112 | AG | 1.64 | 1250 | 880 | 550 | 56 | 860 | 10 | 150 | 150 | 100 | Comparative Example |
| 113 | AH | 1.62 | 1250 | 880 | 550 | 56 | 860 | 10 | 150 | 150 | 100 | Comparative Example |
| 114 | AI | 1.63 | 1250 | 880 | 550 | 56 | 860 | 2000 | 150 | 150 | 100 | Comparative Example |
| 115 | AJ | 1.63 | 1250 | 880 | 550 | 56 | 860 | 2000 | 150 | 150 | 100 | Comparative Example |
| 116 | AK | 1.64 | 1250 | 880 | 550 | 56 | 860 | 2000 | 150 | 150 | 100 | Comparative Example |
| 117 | AL | 1.64 | 1250 | 880 | 550 | 56 | 900 | 2000 | 150 | 150 | 100 | Comparative Example |
| 118 | AM | 1.62 | 1250 | 880 | 550 | 56 | 860 | 10 | 150 | 150 | 100 | Comparative Example |
| 119 | AN | 1.63 | 1250 | 880 | 550 | 56 | 860 | 10 | 150 | 150 | 100 | Comparative Example |
| 120 | AO | 1.64 | 1250 | 880 | 550 | 56 | 860 | 2000 | 150 | 150 | 100 | Comparative Example |
| 121 | AP | 1.62 | 1250 | 880 | 550 | 56 | 860 | 10 | 150 | 150 | 100 | Comparative Example |

*1: Slab heating temperature
*2: Finishing delivery temperature
*3: Coiling temperature
*4: Average cooling rate in temperature range from annealing temperature to 550° C.

2. Evaluation Methods

For the steel sheets obtained under various production conditions, steel microstructures were analyzed to determine microstructure fractions; the average number and average grain size of inclusions were measured; a tensile test was performed to evaluate tensile properties such as tensile strength; and a critical load stress described below was determined by a delayed fracture test to evaluate delayed fracture resistance. Evaluation methods are as described below.

(Total Area Fraction of One or Two of Bainite Containing Carbide Grains Having Average Grain Size of 50 nm or Less and Martensite Containing Carbide Grains Having Average Grain Size of 50 nm or Less Relative to Whole Microstructure of Steel Sheet)

A test piece was taken from the steel sheet obtained in the above annealing step (hereinafter referred to as the annealed steel sheet) from a direction perpendicular to the steel sheet. An L-section in the thickness direction parallel to the rolling direction was mirror polished, subjected to microstructure revelation with nital, and then observed using a scanning electron microscope. A grid of 16 mm×15 mm at 4.8-μm intervals was arranged in a region with an actual length of 82 μm×57 μm in an SEM image at a magnification of ×1500, and using a point counting method involving counting the number of points on each phase, the area fractions of martensite containing carbide grains having an average grain size of 50 nm or less and bainite containing carbide grains having an average grain size of 50 nm or less were calculated, and the total area fraction was calculated. The average of three area fractions determined from different SEM images captured at a magnification of ×1500 was used as the area fraction. Martensite appeared as a white microstructure, and bainite appeared as a black microstructure in which fine carbide grains were precipitated. The average grain size of the carbide grains in bainite and martensite was calculated as described below. The area fraction was an area fraction relative to the whole observation area, and this area fraction was considered as an area fraction relative to the whole microstructure of the steel sheet.

(Average Grain Size of Carbide Grains in Bainite and Martensite)

A test piece was taken from a direction perpendicular to the rolling direction of the annealed steel sheet. An L-section in the thickness direction parallel to the rolling direction was mirror polished, subjected to microstructure revelation with nital, and then observed using a scanning electron microscope. The total area of carbide grains in an SEM image captured at a magnification of ×5000 was determined by a binary image analysis, and the total area was divided by the number of grains to calculate an area per carbide grain. An equivalent circle diameter determined from the area per carbide grain was used as an average grain size.

(Measurement of Average Number and Average Grain Size of Inclusions)

The annealed steel sheet was sheared in a direction (C direction) perpendicular to the rolling direction (L direction) to prepare a test piece. Next, the sheared surface (the section perpendicular to the rolling direction) was mirror polished, and subjected to microstructure revelation with nital, after which an image of the sheared surface (the section perpendicular to the rolling direction) was captured at a magnification of ×400 using a light microscope. The image was observed to count the number of inclusions having an average grain size of 5 μm or more. The counted number was then divided by the area ($mm^2$) of the observed image to calculate the average number per 1 $mm^2$. In the observed image, the parent phase appeared as a white or gray microstructure, and the inclusions appeared black. The areas of the inclusions were determined by a binary image analysis, and equivalent circle diameters were calculated from the areas. The equivalent circle diameters of the inclusions were averaged by the number of inclusions to calculate the average grain size.

(Tensile Test)

A JIS No. 5 test piece having a gauge length of 50 mm, a gauge width of 25 mm, and a thickness of 1.4 mm was taken from the rolling direction of the annealed steel sheet, and a tensile test was performed at a tensile speed of 10 mm/min in accordance with JIS Z 2241 (2011) to determine a tensile strength (TS) and a yield strength (YS).

(Evaluation of Delayed Fracture Resistance)

A critical load stress was determined by a delayed fracture test. Specifically, the steel sheet subjected to the above bending was immersed in hydrochloric acid having a pH of 1 (25° C.) and evaluated for a critical load stress, that is, a maximum load stress under which delayed fracture did not occur. The occurrence of delayed fracture was judged by visual observation and by using an image magnified at ×20 under a stereoscopic microscope, and cases where cracking did not occur after 100-hour immersion were judged as no fracture. Here, cracking refers to cases where a crack having a crack length of 200 μm or more occurred.

For the delayed fracture resistance, samples satisfying critical load stress ≥YS were evaluated as "acceptable (good)", and samples satisfying critical load stress <YS as "unacceptable (poor)".

3. Evaluation Results

The results of the above evaluations are shown in Tables 5 to 7.

TABLE 5

| | | Steel microstructure | | Evaluation | | | | |
|---|---|---|---|---|---|---|---|---|
| No. | Steel type | *1 (%) | *2 (number/$mm^2$) | YS (MPa) | TS (MPa) | Critical load stress (MPa) | Delayed fracture resistance | Remarks |
| 1 | A | 94 | 2.8 | 1512 | 1810 | 1739 | good | Example |
| 2 | | 95 | 3.4 | 1452 | 1720 | 1670 | good | Example |
| 3 | | 95 | 5.2 | 1537 | 1820 | 1460 | poor | Comparative Example |
| 4 | | 96 | 3.0 | 1376 | 1800 | 1582 | good | Example |
| 5 | | 92 | 2.6 | 1480 | 1810 | 1652 | good | Example |
| 6 | | 98 | 5.6 | 1551 | 1780 | 1473 | poor | Comparative Example |
| 7 | B | 95 | 6.8 | 1512 | 1790 | 1436 | poor | Comparative Example |
| 8 | | 100 | 2.8 | 1609 | 1810 | 1850 | good | Example |
| 9 | | 93 | 2.6 | 1324 | 1720 | 1589 | good | Example |
| 10 | | 99 | 2.8 | 1364 | 1550 | 1519 | good | Example |
| 11 | | 96 | 3.0 | 1306 | 1530 | 1501 | good | Example |
| 12 | | 98 | 3.0 | 1232 | 1790 | 1416 | good | Example |
| 13 | C | 94 | 2.8 | 1320 | 1580 | 1518 | good | Example |
| 14 | | 96 | 3.4 | 1357 | 1590 | 1578 | good | Example |
| 15 | | 100 | 4.6 | 1431 | 1610 | 1646 | good | Example |
| 16 | | 90 | 5.2 | 1248 | 1560 | 1186 | poor | Comparative Example |
| 17 | D | 98 | 2.8 | 1368 | 1570 | 1573 | good | Example |
| 18 | | 93 | 3.6 | 1637 | 1980 | 1882 | good | Example |
| 19 | | 97 | 4.2 | 1733 | 2010 | 1943 | good | Example |
| 20 | | 99 | 5.2 | 1760 | 2000 | 1672 | poor | Comparative Example |
| 21 | E | 93 | 6.6 | 1629 | 1970 | 1547 | poor | Comparative Example |
| 22 | | 92 | 3.0 | 1369 | 1770 | 1574 | good | Example |
| 23 | | 91 | 2.8 | 1448 | 1790 | 1737 | good | Example |
| 24 | | 100 | 3.0 | 1618 | 1820 | 1860 | good | Example |
| 25 | | 90 | 6.8 | 1224 | 1580 | 1163 | poor | Comparative Example |
| 26 | | 90 | 3.0 | 1424 | 1570 | 1638 | good | Example |
| 27 | F | 100 | 3.0 | 1609 | 1810 | 1850 | good | Example |
| 28 | | 97 | 2.6 | 1496 | 1790 | 1745 | good | Example |
| 29 | | 98 | 2.6 | 1568 | 1800 | 1803 | good | Example |
| 30 | | 93 | 2.8 | 1432 | 1670 | 1646 | good | Example |
| 31 | | 91 | 2.8 | 1503 | 1580 | 1729 | good | Example |
| 32 | | 88 | 2.8 | 1259 | 1390 | 1181 | poor | Comparative Example |
| 33 | G | 94 | 2.8 | 1291 | 1650 | 1434 | good | Example |
| 34 | | 93 | 2.6 | 1344 | 1680 | 1546 | good | Example |

TABLE 5-continued

| No. | Steel type | Steel microstructure *1 (%) | Steel microstructure *2 (number/mm$^2$) | Evaluation YS (MPa) | Evaluation TS (MPa) | Evaluation Critical load stress (MPa) | Evaluation Delayed fracture resistance | Remarks |
|---|---|---|---|---|---|---|---|---|
| 35 | | 91 | 3.0 | 1430 | 1630 | 1645 | good | Example |
| 36 | | 82 | 2.8 | 1123 | 1340 | 1052 | poor | Comparative Example |
| 37 | H | 96 | 3.0 | 1493 | 1750 | 1717 | good | Example |
| 38 | | 99 | 2.6 | 1549 | 1760 | 1731 | good | Example |
| 39 | | 91 | 2.6 | 1170 | 1530 | 1404 | good | Example |
| 40 | | 91 | 2.6 | 1246 | 1540 | 1433 | good | Example |

*1: Total area fraction of one or two of bainite containing carbide grains having average grain size of 50 nm or less and martensite containing carbide grains having average grain size of 50 nm or less
*2: Average number per 1 mm$^2$ of inclusions having average grain size of 5 μm or more that are present in section perpendicular to rolling direction

15

TABLE 6

| No. | Steel type | Steel microstructure *1 (%) | Steel microstructure *2 (number/mm$^2$) | Evaluation YS (MPa) | Evaluation TS (MPa) | Evaluation Critical load stress (MPa) | Evaluation Delayed fracture resistance | Remarks |
|---|---|---|---|---|---|---|---|---|
| 41 | I | 98 | 2.6 | 1287 | 1540 | 1480 | good | Example |
| 42 | | 98 | 2.6 | 1359 | 1560 | 1563 | good | Example |
| 43 | | 93 | 2.6 | 1273 | 1540 | 1414 | good | Example |
| 44 | | 85 | 2.8 | 1309 | 1350 | 1505 | good | Comparative Example |
| 45 | J | 100 | 2.6 | 1671 | 1880 | 1922 | good | Example |
| 46 | | 96 | 2.8 | 1464 | 1810 | 1684 | good | Example |
| 47 | | 94 | 3.0 | 1521 | 1820 | 1749 | good | Example |
| 48 | | 91 | 3.0 | 1488 | 1740 | 1662 | good | Example |
| 49 | | 90 | 2.6 | 1471 | 1680 | 1622 | good | Example |
| 50 | | 78 | 3.0 | 1129 | 1370 | 1048 | poor | Comparative Example |
| 51 | K | 93 | 6.8 | 1158 | 1570 | 1100 | poor | Comparative Example |
| 52 | | 92 | 3.0 | 1325 | 1620 | 1524 | good | Example |
| 53 | | 97 | 3.0 | 1440 | 1670 | 1606 | good | Example |
| 54 | | 91 | 2.8 | 1278 | 1580 | 1470 | good | Example |
| 55 | | 95 | 3.0 | 1351 | 1600 | 1554 | good | Example |
| 56 | | 92 | 2.6 | 1086 | 1490 | 1249 | good | Example |
| 57 | L | 93 | 3.0 | 1356 | 1640 | 1559 | good | Example |
| 58 | | 90 | 2.6 | 1296 | 1520 | 1440 | good | Example |
| 59 | | 80 | 2.6 | 1074 | 1310 | 1235 | good | Comparative Example |
| 60 | M | 95 | 3.0 | 1288 | 1670 | 1481 | good | Example |
| 61 | | 94 | 2.6 | 1379 | 1650 | 1585 | good | Example |
| 62 | | 93 | 2.6 | 1455 | 1620 | 1673 | good | Example |
| 63 | N | 95 | 3.0 | 1537 | 1820 | 1767 | good | Example |
| 64 | | 91 | 2.8 | 1496 | 1710 | 1671 | good | Example |
| 65 | | 81 | 2.8 | 1270 | 1440 | 1192 | poor | Comparative Example |
| 66 | O | 91 | 2.8 | 1335 | 1650 | 1535 | good | Example |
| 67 | | 90 | 3.0 | 1312 | 1640 | 1509 | good | Example |
| 68 | | 97 | 2.6 | 1449 | 1680 | 1666 | good | Example |
| 69 | P | 96 | 3.0 | 1408 | 1650 | 1569 | good | Example |
| 70 | | 97 | 2.8 | 1431 | 1660 | 1646 | good | Example |
| 71 | | 94 | 3.0 | 1370 | 1640 | 1576 | good | Example |
| 72 | Q | 94 | 2.6 | 1420 | 1700 | 1634 | good | Example |
| 73 | | 91 | 3.0 | 1327 | 1640 | 1476 | good | Example |
| 74 | | 80 | 2.8 | 1304 | 1630 | 1239 | poor | Comparative Example |
| 75 | R | 94 | 2.6 | 1613 | 1930 | 1855 | good | Example |
| 76 | | 100 | 2.6 | 1742 | 1960 | 2004 | good | Example |
| 77 | | 87 | 2.6 | 1415 | 1830 | 1344 | poor | Comparative Example |
| 78 | S | 100 | 2.6 | 1591 | 1790 | 1830 | good | Example |
| 79 | | 92 | 3.0 | 1415 | 1730 | 1627 | good | Example |
| 80 | | 92 | 2.6 | 1203 | 1650 | 1333 | good | Example |

*1: Total area fraction of one or two of bainite containing carbide grains having average grain size of 50 nm or less and martensite containing carbide grains having average grain size of 50 nm or less
*2: Average number per 1 mm$^2$ of inclusions having average grain size of 5 μm or more that are present in section perpendicular to rolling direction

TABLE 7

| | | Steel microstructure | | Evaluation | | | | |
|---|---|---|---|---|---|---|---|---|
| No. | Steel type | *1 (%) | *2 (number/mm$^2$) | YS (MPa) | TS (MPa) | Critical load stress (MPa) | Delayed fracture resistance | Remarks |
| 81 | T | 85 | 2.6 | 1461 | 1730 | 1388 | poor | Comparative Example |
| 82 | | 96 | 3.0 | 1485 | 1740 | 1708 | good | Example |
| 83 | | 87 | 3.0 | 1509 | 1750 | 1433 | poor | Comparative Example |
| 84 | U | 97 | 2.8 | 1474 | 1710 | 1696 | good | Example |
| 85 | | 96 | 3.0 | 1451 | 1700 | 1668 | good | Example |
| 86 | | 94 | 6.8 | 1404 | 1680 | 1334 | poor | Comparative Example |
| 87 | V | 96 | 2.8 | 1382 | 1620 | 1540 | good | Example |
| 88 | | 94 | 2.6 | 1362 | 1630 | 1566 | good | Example |
| 89 | | 94 | 5.8 | 1362 | 1630 | 1294 | poor | Comparative Example |
| 90 | W | 99 | 2.6 | 1478 | 1680 | 1700 | good | Example |
| 91 | | 95 | 2.8 | 1402 | 1660 | 1562 | good | Example |
| 92 | | 98 | 5.2 | 1455 | 1670 | 1382 | poor | Comparative Example |
| 93 | X | 94 | 2.8 | 1310 | 1630 | 1441 | good | Example |
| 94 | | 91 | 2.8 | 1362 | 1610 | 1498 | good | Example |
| 95 | | 86 | 3.0 | 1325 | 1440 | 1259 | poor | Comparative Example |
| 96 | Y | 94 | 6.0 | 1354 | 1620 | 1286 | poor | Comparative Example |
| 97 | | 99 | 4.6 | 1443 | 1640 | 1588 | good | Example |
| 98 | | 94 | 3.0 | 1362 | 1630 | 1498 | good | Example |
| 99 | Z | 93 | 2.2 | 1298 | 1570 | 1428 | good | Example |
| 100 | | 94 | 2.2 | 1312 | 1570 | 1443 | good | Example |
| 101 | | 82 | 2.2 | 1276 | 1360 | 1403 | good | Comparative Example |
| 102 | AA | 98 | 2.8 | 1234 | 1550 | 1448 | good | Example |
| 103 | | 94 | 3.0 | 1287 | 1540 | 1415 | good | Example |
| 104 | | 90 | 2.8 | 1224 | 1530 | 1346 | good | Example |
| 105 | AB | 99 | 2.0 | 1513 | 1760 | 1694 | good | Example |
| 106 | | 97 | 2.2 | 1523 | 1760 | 1664 | good | Example |
| 107 | | 98 | 2.6 | 1526 | 1780 | 1714 | good | Example |
| 108 | AC | 97 | 2.4 | 1230 | 1520 | 1420 | good | Example |
| 109 | AD | 97 | 2.3 | 1505 | 1870 | 1710 | good | Example |
| 110 | AE | 93 | 2.6 | 1521 | 1840 | 1445 | poor | Comparative Example |
| 111 | AF | 83 | 2.6 | 1055 | 1430 | 1161 | good | Comparative Example |
| 112 | AG | 92 | 6.8 | 1431 | 1750 | 1360 | poor | Comparative Example |
| 113 | AH | 90 | 7.0 | 1384 | 1730 | 1315 | poor | Comparative Example |
| 114 | AI | 80 | 3.0 | 1368 | 1410 | 1505 | good | Comparative Example |
| 115 | AJ | 93 | 3.0 | 1347 | 1630 | 1280 | poor | Comparative Example |
| 116 | AK | 90 | 6.6 | 1356 | 1620 | 1288 | poor | Comparative Example |
| 117 | AL | 96 | 2.6 | 1487 | 1660 | 1413 | poor | Comparative Example |
| 118 | AM | 94 | 3.0 | 1513 | 1730 | 1437 | poor | Comparative Example |
| 119 | AN | 93 | 2.8 | 1520 | 1740 | 1444 | poor | Comparative Example |
| 120 | AO | 83 | 3.0 | 1515 | 1710 | 1439 | poor | Comparative Example |
| 121 | AP | 84 | 3.0 | 1530 | 1730 | 1454 | poor | Comparative Example |

*1: Total area fraction of one or two of bainite containing carbide grains having average grain size of 50 nm or less and martensite containing carbide grains having average grain size of 50 nm or less
*2: Average number per 1 mm$^2$ of inclusions having average grain size of 5 μm or more that are present in section perpendicular to rolling direction In the EXAMPLES, samples satisfying TS≥1470 MPa and critical load stress ≥YS were evaluated as acceptable and designated as Examples in Tables 5 to 7. On the other hand, samples satisfying TS <1470 MPa or critical load stress <YS were evaluated as unacceptable and designated as Comparative Example in Tables 5 to 7.

The results of the Examples and Comparative Examples show that the disclosed embodiments can provide a high-strength steel sheet having high delayed fracture resistance and a method for manufacturing the high-strength steel sheet.

The invention claimed is:

1. A steel sheet having a chemical composition comprising, by mass %: C: 0.17% or more and 0.35% or less; Si: 0.001% or more and 1.2% or less; Mn: 0.9% or more and 3.2% or less; P: 0.02% or less; S: 0.001% or less; Al: 0.01% or more and 0.2% or less; N: 0.010% or less; and the balance being Fe and unavoidable impurities, wherein, relative to a whole microstructure of the steel sheet, a total area fraction of at least one of (i) bainite containing carbide grains having an average grain size of 50 nm or less and (ii) martensite containing carbide grains having an average grain size of 50 nm or less is 90% or more, and an average number of inclusions having an average grain size of 5 μm or more that are present in a section of the steel sheet perpendicular to a rolling direction is 5.0/mm$^2$ or less, and a tensile strength of 1470 MPa or more, wherein the steel sheet has a critical load stress that is equal to or higher than a yield strength of the steel sheet.

2. The steel sheet according to claim 1, wherein the chemical composition further comprises, by mass %, Sb: 0.001% or more and 0.1% or less.

3. The steel sheet according to claim 2, wherein the chemical composition further comprises, by mass %, at least one Group selected from the group consisting of:

Group A: B: 0.0002% or more and less than 0.0035%,

Group B: at least one selected from the group consisting of Nb: 0.002% or more and 0.08% or less, and Ti: 0.002% or more and 0.12% or less, Group C: at least one selected from the group consisting of Cu: 0.005% or more and 1% or less, and Ni: 0.005% or more and 1% or less, Group D: at least one selected from the group consisting of Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less, Group E: at least one selected from the group consisting of Ca: 0.0002% or more and 0.0030% or less, Ce: 0.0002% or more and 0.0030% or less, La: 0.0002% or more and 0.0030% or less, and Mg: 0.0002% or more and 0.0030% or less, and Group F: at least one selected from the group consisting of Sn: 0.002% or more and 0.1% or less.

4. A method for manufacturing the steel sheet according to claim 2, the method comprising:

hot rolling by casting a steel having the chemical composition at a casting speed of 1.80 m/min or less, then hot rolling the casted steel at a slab heating temperature of 1200° C. or higher and a finishing delivery temperature of 840° C. or higher to form a hot-rolled steel sheet;

coiling the hot-rolled steel sheet at a coiling temperature of 630° C. or lower;

cold rolling the hot-rolled steel sheet to form a cold-rolled steel sheet; and annealing by heating the cold-rolled steel sheet to an annealing temperature of $A_{C3}$ point or higher, then cooling the cold-rolled steel sheet to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for in a range of 20 seconds or more and 1500 seconds or less.

5. A method for manufacturing the steel sheet according to claim 3, the method comprising:

hot rolling by casting a steel having the chemical composition at a casting speed of 1.80 m/min or less, then hot rolling the casted steel at a slab heating temperature of 1200° C. or higher and a finishing delivery temperature of 840° C. or higher to form a hot-rolled steel sheet;

coiling the hot-rolled steel sheet at a coiling temperature of 630° C. or lower;

cold rolling the hot-rolled steel sheet to form a cold-rolled steel sheet; and annealing by heating the cold-rolled steel sheet to an annealing temperature of $A_{C3}$ point or higher, then cooling the cold-rolled steel sheet to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for in a range of 20 seconds or more and 1500 seconds or less.

6. The steel sheet according to claim 1, wherein the chemical composition further comprises, by mass %, at least one Group selected from the group consisting of:

Group A: B: 0.0002% or more and less than 0.0035%,

Group B: at least one selected from the group consisting of Nb: 0.002% or more and 0.08% or less, and Ti: 0.002% or more and 0.12% or less, Group C: at least one selected from the group consisting of Cu: 0.005% or more and 1% or less, and Ni: 0.005% or more and 1% or less, Group D: at least one selected from the group consisting of Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less, Group E: at least one selected from the group consisting of Ca: 0.0002% or more and 0.0030% or less, Ce: 0.0002% or more and 0.0030% or less, La: 0.0002% or more and 0.0030% or less, and Mg: 0.0002% or more and 0.0030% or less, and Group F: at least one selected from the group consisting of Sn: 0.002% or more and 0.1% or less.

7. A method for manufacturing the steel sheet according to claim 6, the method comprising:

hot rolling by casting a steel having the chemical composition at a casting speed of 1.80 m/min or less, then hot rolling the casted steel at a slab heating temperature of 1200° C. or higher and a finishing delivery temperature of 840° C. or higher to form a hot-rolled steel sheet;

coiling the hot-rolled steel sheet at a coiling temperature of 630° C. or lower;

cold rolling the hot-rolled steel sheet to form a cold-rolled steel sheet; and annealing by heating the cold-rolled steel sheet to an annealing temperature of $A_{C3}$ point or higher, then cooling the cold-rolled steel sheet to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for in a range of 20 seconds or more and 1500 seconds or less.

8. A method for manufacturing the steel sheet according to claim 1, the method comprising:

hot rolling by casting a steel having the chemical composition at a casting speed of 1.80 m/min or less, then hot rolling the casted steel at a slab heating temperature of 1200° C. or higher and a finishing delivery temperature of 840° C. or higher to form a hot-rolled steel sheet;

coiling the hot-rolled steel sheet at a coiling temperature of 630° C. or lower;

cold rolling the hot-rolled steel sheet to form a cold-rolled steel sheet; and annealing by heating the cold-rolled steel sheet to an annealing temperature of $A_{C3}$ point or higher, then cooling the cold-rolled steel sheet to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for in a range of 20 seconds or more and 1500 seconds or less.

* * * * *